US008616157B2

(12) United States Patent
Xiao et al.

(10) Patent No.: US 8,616,157 B2
(45) Date of Patent: Dec. 31, 2013

(54) APPARATUS AND METHOD FOR GENERATING STEAM

(75) Inventors: Taikang Xiao, Singapore (SG); Roel Alexander Rethmeier, Singapore (SG); Tamilselvan Thirumazhisai Sankaralingam, Singapore (SG); Barry Eng Keong Tay, Singapore (SG); Hock Soon Tiew, Singapore (SG); Chaitra Belle, Singapore (SG)

(73) Assignee: Koninklijke Philips N.V., Eindhoven (NL)

( * ) Notice: Subject to any disclaimer, the term of this patent is extended or adjusted under 35 U.S.C. 154(b) by 918 days.

(21) Appl. No.: 12/158,124

(22) PCT Filed: Dec. 8, 2006

(86) PCT No.: PCT/IB2006/054676

§ 371 (c)(1),
(2), (4) Date: Jun. 19, 2008

(87) PCT Pub. No.: WO2007/072271

PCT Pub. Date: Jun. 28, 2007

(65) Prior Publication Data

US 2008/0264354 A1 Oct. 30, 2008

(30) Foreign Application Priority Data

Dec. 19, 2005 (EP) ..... 05112354

(51) Int. Cl.
*F22B 1/30* (2006.01)

(52) U.S. Cl.
USPC ..... 122/4 A; 392/324; 392/328

(58) Field of Classification Search
USPC ..... 122/4 A, 451.2, 452, 457, 459; 219/245, 219/424, 430, 439, 443.1, 444.1, 446.1, 219/448.16, 448.18, 468.1; 392/324, 328
See application file for complete search history.

(56) References Cited

U.S. PATENT DOCUMENTS

| | | | | | |
|---|---|---|---|---|---|
| 1,357,891 | A | * | 11/1920 | Murray | 392/445 |
| 1,766,802 | A | * | 6/1930 | Sanders | 392/401 |
| 4,213,299 | A | * | 7/1980 | Sharar | 60/676 |
| 5,054,105 | A | | 10/1991 | Kiyimaa et al. | |
| 5,487,329 | A | * | 1/1996 | Fissler | 99/403 |
| 5,532,461 | A | * | 7/1996 | Crummenauer et al. | 219/621 |
| 5,804,791 | A | * | 9/1998 | Gelus | 219/245 |

(Continued)

FOREIGN PATENT DOCUMENTS

| | | | |
|---|---|---|---|
| DE | 4029511 | A1 | 3/1992 |
| EP | 0193863 | A2 | 9/1986 |
| EP | 0821096 | A1 | 1/1998 |
| EP | 0843039 | B1 | 11/2001 |
| FR | 2861974 | A1 | 5/2005 |
| JP | 61250421 | A | 11/1986 |
| JP | 2001511676 | A | 8/2001 |
| JP | 2003173983 | A | 6/2003 |
| JP | 2003217799 | A | 7/2003 |
| JP | 2005246472 | A | 9/2005 |
| JP | 2005288536 | A | 10/2005 |
| WO | 2005092557 | A1 | 10/2005 |
| WO | 2006067722 | A2 | 6/2006 |

*Primary Examiner* — Gregory A Wilson

(57) ABSTRACT

A steam generating apparatus includes a body for receiving water to be heated and has a first portion including a first metal, and a heating device having a second portion including a second metal. The heating device includes a heating plate connected with the body by forming an intermetallic layer between the first and second portions. A temperature sensor measures temperature indicative of pressure inside the body and thermally contacts the heating device outside the body. A method of controlling the pressure of steam in the steam generating apparatus includes setting the target water temperature for a first time period to a first set temperature; setting the target water temperature for a second time period to a second set temperature higher than the first set temperature; and setting the target water temperature for a third time period to a third set temperature lower than the second set temperature.

22 Claims, 5 Drawing Sheets

(56) References Cited

U.S. PATENT DOCUMENTS 5,852,283 A * 12/1998 O'Neill ..... 219/448.18
5,881,207 A * 3/1999 DeBourg et al. ..... 392/401
5,948,304 A * 9/1999 Bradenbaugh ..... 219/496
7,320,277 B2 * 1/2008 Vanthoor ..... 99/422
2004/0004185 A9 1/2004 Guevremont et al.
2009/0057294 A1 * 3/2009 Chang ..... 219/443.1
2010/0140251 A1 * 6/2010 Shei et al. ..... 219/430

* cited by examiner

APPARATUS AND METHOD FOR GENERATING STEAM

FIELD OF THE INVENTION

The present invention generally relates to a steam generating apparatus and to a method of controlling the pressure of steam in a steam generating apparatus. In particular, the invention relates to a steam generating apparatus having improved heat transfer properties and to a method of controlling the pressure of steam in a steam generating device on the basis of these heat transfer properties.

BACKGROUND OF THE INVENTION

The heating of water, e.g. for generating steam, may be performed in water heating apparatuses or boilers. In these systems, the temperature of the water can be controlled within a certain temperature range by means of a heating device and a temperature sensor as follows: When the temperature signal of the temperature sensor indicates, that the temperature of the water falls below a certain level, the heating device is activated and the water is heated. If the temperature signal indicates, that the water temperature rises above a certain level, the heating device is deactivated.

Heating the water for the generation of steam requires water heating means under pressure and a control of the pressure of the steam. The controlling of the steam pressure can be performed directly by the use of a pressure sensor or indirectly by the use of a temperature sensor. Controlling the pressure by sensing the water temperature makes use of the correlation of the steam pressure and the temperature in the boiler, since during a heating of the water the steam pressure rises, and it decreases, when the water in the boiler is cooling down.

For controlling the pressure in the boiler on the basis of the measured temperature, the temperature of the water needs to be sensed accurately. In particular, the arrangement of the temperature sensor is critical. The sensor may be attached to the side walls of the boiler shell or to the bottom of the boiler shell.

Arranging the temperature sensor at the side walls requires a flat portion for a proper mounting of the sensor, which in turn complicates the forming of the shell. In some of these arrangements a heat conductive paste is applied between the temperature sensor and the boiler shell. This makes additional mounting processes necessary.

Attaching the temperature sensor at the bottom of the boiler shell also is disadvantageously. Some boilers comprise a heating plate with an embedded heating element. The heating plate usually is mounted to the bottom of the boiler shell by means of bolts or screws. A layer of thermal conducting material, e.g. graphite, may be arranged between the boiler and the heating plate to fill the air gap and to improve the heat transfer. However, the heat transfer between the boiler shell and the heating plate is not optimal. Especially during power up the water temperature and the temperature of the heating plate differ considerably. This causes a time delay in the temperature-time curve at the sensing location compared with the temperature-time curve of the water, since the heat transfer from the heating element into the water is considerably delayed. Furthermore, the spatial and temporal temperature distribution in the boiler is not even. For example, water within the sensing area of a sensor attached remotely from the heating device may be heated up later than water within the region of the heating device. This tends to cause either an overshooting of the steam pressure or the opposite.

It is an object of the invention to provide an apparatus and a method of generating steam providing an improved capability of controlling the steam pressure.

SUMMARY OF THE INVENTION

This object is solved by the features of the independent claims. Further developments and preferred embodiments of the invention are outlined in the dependent claims.

In accordance with a first aspect of the invention, there is provided a steam generating apparatus, comprising a body for receiving water to be heated and comprising a first portion comprising a first metal, and a heating device comprising a second portion comprising a second metal, wherein the heating device comprises a heating plate connected with the body by forming an intermetallic layer between the first portion and the second portion, and a temperature sensor for measuring a temperature that is indicative of a pressure inside the body is arranged in thermal contact to the heating device outside the body. The intermetallic layer provides both a mechanical and a thermal connection between the first and second portions of the heating device and the body of the steam generating apparatus. This ensures a rigid mechanical attachment of the heating device to the body and, at the same time, a good heat transfer capability between the two portions on the basis of a single process step. The intermetallic layer may comprise parts of the first metal, the second metal, and/or a third metal, e.g. a soldering metal. Conventional attaching methods like bolting or screwing create an unevenly distributed, mostly spot-like, contact surface. The intermetallic layer provides a large and contiguous contact surface allowing a higher and more uniform heat transfer. The properties of the two metals can be chosen according to the needs of the body and the heating element, respectively. The first metal and the second metal may be each mixture containing two or more metallic elements or metallic and non-metallic elements and may be optimized independently regarding their heat transfer properties. Therefore, the metal of the first portion comprised by the body may be designed to meet the water heating and steam storing requirements, whereas the second metal may be optimized regarding heat generating and transferring requirements. There are several methods of forming the intermetallic layer, which will be discussed below. The temperature sensor may be a thermistor or another sensor producing a signal associated with a sensed temperature. Due to the improved thermal conductivity the temperature sensor may be arranged adjacent to the heating device or may be directly attached to or integrated in the heating device. As a quick heat transfer takes place between the body, the heating device, and the sensing point of the temperature sensor, hence the development of the temperature can be measured by the temperature sensor without much delay.

In this regard, it is advantageous that the first metal is stainless steel. Stainless steel and the like complies with the requirements of low corrosion under a damp heat environment.

Similarly, the second metal is aluminum or an aluminum alloy. These materials combine a good thermal conductivity with good processing properties.

According to a particular embodiment of the present invention, the intermetallic layer is formed by soldering and/or brazing and/or welding. These alternative or combined processing steps create an intermetallic layer between the first portion and the second portion as described above and are well proven methods of joining different metals. Furthermore, metal filled adhesives may also be used to provide a joint showing a high thermal conductivity and a good mechanical connection.

In accordance with an embodiment of the invention, the heating plate comprises a heating element. The heating element may be attached to the heating plate by casting-in, soldering, brazing, welding or similar techniques.

According to a preferred embodiment of the present invention, the heating device comprises control means for controlling the temperature of the water. The generation of steam requires an accurate control of the steam pressure, as discussed above. By utilizing the improved heat transfer capabilities from the body to the heating device and vice versa, an accurate controlling of the water temperature and, in consequence, of the steam pressure may be obtained. Further, the improved heat transfer capability of the intermetallic joint reduces the feedback time in the system and allows for a faster and more accurate control of the water temperature.

In accordance with a second aspect of the invention, there is provided a method of controlling the pressure of steam in a steam generating apparatus comprising a body for receiving water to be heated and comprising a first portion comprising a first metal, a heating device comprising a second portion comprising a second metal, the body being connected with a heating plate of the heating device by forming an intermetallic layer between the first portion and the second portion, and a temperature sensor for measuring a temperature that is indicative of a pressure inside the body, the temperature sensor being arranged in thermal contact to the heating device outside the body, the method comprising the steps of setting the target water temperature for a first time period to a first set temperature, setting the target water temperature for a second time period to a second set temperature higher than the first set temperature, and setting the target water temperature for a third time period to a third set temperature lower than the second set temperature. Adjusting the target temperature of the water to be heated to different temperature levels during several time periods provides a flexible method of controlling the steam pressure of a steam generating device by measuring the water temperature. For example, the steam pressure level may be set to a nominal pressure, corresponding to the first set temperature. During the second time period, a higher temperature setting and therefore also a higher steam pressure level is set. This may be utilized to temporarily raise the steam pressure for providing a steam output at a higher rate without the need to design the components involved for higher pressure. This may be performed at predetermined time periods or in response to a signal or event. Another example is the possibility to compensate for a reduction in the steam pressure that is predictable at a certain time point by respective signals, but not yet detectable via the temperature sensor, as will be discussed later in detail.

According to a preferred embodiment of the invention, the beginning of the second time period and/or the duration of the second time period and/or the second set temperature is at least one of the following: predetermined; a function of the steam output of the steam generating device, and a function of the water input into the steam generating device. Adjusting the target water temperature to a higher level compared to an initial nominal set temperature during a predetermined time period allows for the compensation of regularly appearing steam demands in advance. The beginning of the second time period and its duration may be adjusted in a flexible way to correspond to the expected steam rate output. Further, the configuration of the second time period and a corresponding set temperature may be correlated to the current steam output. For example, the second time period may reflect the current output steam rate and its duration. Accordingly, the same holds for the amount of water input into the steam generating device. Appropriate signals communicating the triggering of the steam output or the water input may be a switch actuated by the user or an electrical signal activating a water pump.

According to a further embodiment of the present invention, the duration of the second time period equals the duration of the steam output or the duration of the water input. In addition, the beginning of the second time period may coincide with the beginning of the steam output and the beginning of the water input, respectively. This is a simple way of improving the controlling of the steam pressure by adding additional heat at appropriate time periods.

Particularly, the second time period is elongated by a time period being a function of at least one of the following: the duration of the steam output, and the duration of the water input. According to the amount of heat power being transferred into the water and according to other aspects of the steam generating device, appropriate heating periods can be chosen to compensate for the heat loss caused by a steam output and a water input, respectively.

It is also preferred, that the step of controlling the water temperature at the second temperature comprises the step of activating the heating device in the case of at least one of the following: the current water temperature is lower than the second temperature; a steam output is requested; and a water input is performed. During the second time period the heating device transfers heat into the water, whenever one of the mentioned events takes place. Even if the current water temperature is still higher than the second temperature, the heating device is activated for preventing or mitigating a future pressure drop.

According to a particular embodiment of the present invention, the step of controlling the water temperature at the second temperature comprises the step of deactivating the heating device, if the current water temperature is higher than a maximum temperature. In order to prevent an excessive increase in steam pressure, the current water temperature is limited to a maximum temperature.

Particularly, the step of controlling the water temperature at the second temperature comprises the step of deactivating the heating device after a time period being a function of at least one of the following: the duration of the steam output; and the duration of the water input.

These and other aspects of the invention will be apparent from and elucidated with reference to the embodiments described hereinafter.

DESCRIPTION OF PREFERRED EMBODIMENTS

Figure 1:
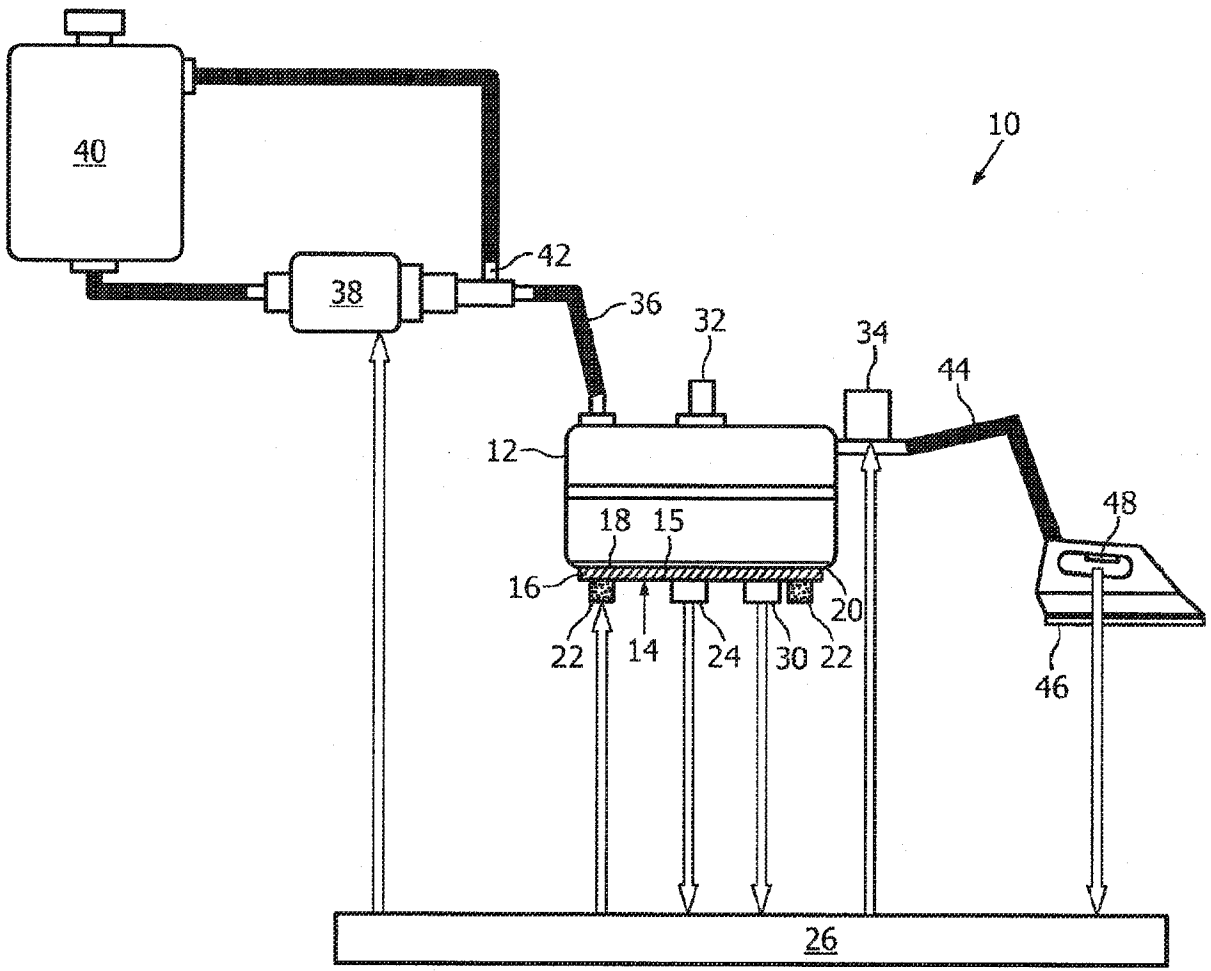
FIG. 1 shows a schematical set up of a steam generating device according to the present invention.

FIG. 1 shows a schematical set up of a steam generating device according to the present invention. The steam generating device 10 comprises a water boiler 12 being manufactured by connecting at least two formed metal shells of stainless steal. The boiler 12 has a flat bottom portion 16 and is mounted in a plastic enclosure in a horizontal arrangement. Other orientations like a non horizontal arrangement are also possible. The flat bottom portion 16 of the boiler 12 is attached to a heating device 14 comprising a heating plate 15 and a heating element 22. The heating plate is made of aluminum—an aluminum alloy or other materials with excellent heat conductivity can also be used. The heating plate 15 comprises a flat upper portion 18 and is attached with its flat upper portion 18 to the flat bottom portion 16 of the body 12 by formation of an intermetallic layer 20. The intermetallic layer 20 may be formed by welding, brazing, soldering, and the like. The heating element 22 is attached to the heating plate 15 also by forming an intermetallic layer by welding, brazing, soldering, a similar joining method or by casting-in, to ensure a good heat transfer. Further, the heating device 14 comprises a temperature sensor 24 and a water level sensor 30. The boiler 12 of the steam generating device 10 is further equipped with a safety valve 32, an electrical steam output valve 34 and a feed water inlet 36. The feed water inlet 36 of the boiler 12 is connected with an electrical water pump 38 connected with a water tank 40. Between the water pump 38 and the feed water inlet 36, a de-airing valve 42 is provided, enabling a connection of the boiler 12 with the water tank 40 being open to the atmosphere. Furthermore, the boiler 12 is connected via an electrical steam output valve 34 and a steam delivery hose 44 with a steam iron 46. The steam iron comprises a steam trigger 48. An electronic control unit 26 is connected with the water pump 38, the heating element 22, the temperature sensor 24, the water level sensor 30, the electrical steam output valve 34, and with the steam trigger 48 of the steam iron 48.

The steam generating device 10 is suitable for use in a domestic appliance comprising, besides the steam ironing device shown as a preferred embodiment, a steamer, a steam cleaner, an active ironing board, a facial sauna, a steam cooking device, a coffee making machine and the like. The water level sensor 30 is used to detect changes in the water level of the boiler 12. When the water level is lower than a certain level or the boiler 12 is empty, the water level sensor 30 sends a signal to the electronic control unit 26. The electronic control unit 26 activates the pump 38 to feed water into the boiler 12 for raising the water level. When the water level in the boiler 12 is higher than the certain level, the water level sensor 30 sends an appropriate signal to the electronic control unit 26. The electronic control unit 26 deactivates a pump 38 to stop pumping. In this way, the water level of the boiler 12 is maintained within a certain range. The de-airing valve 42 provides a connection of the boiler 12 with the atmosphere to prevent the boiler 12 from being overfilled with water, if during cooling down after use a vacuum is formed inside the boiler 12. The water level sensor 30 may be mounted on the heating plate 15 (as shown) or alternatively on the boiler shell, on the side walls of the boiler 12 or even inside the boiler 12 depending on the sensing method used. If the water level sensing is done based on the temperature from the temperature sensor 24, the temperature sensor 24 can be used as the water level sensor.

The temperature sensor 24 is mounted on the heating plate 15. In this way, the temperature sensor 24 is located adjacent to an area being in good thermal contact with the water inside the boiler 12 in order to properly sense the water temperature. Since the steam pressure of the water inside the boiler 12 is directly related to the water temperature, the temperature sensor 24 is used to control the pressure of the water. If the sensed temperature is lower than a preset temperature value, the pressure is also lower than the required level. In this case, the electronic control unit 26 activates the heating element 12. If the temperature sensor 24 signals a water temperature reaching or exceeding the preset temperature value, the heating element 22 is turned off by the electronic control unit 26. This is a simple way of controlling the steam pressure inside the boiler 12. More sophisticated methods are described in relation to FIGS. 2 to 5. It is an advantage of the invention, to change the preset temperature value for the water inside the boiler 12. Thus, the pressure of the boiler can be set to different levels improving the delivery of steam at different steam rates during normal use. Further, during cool start-up of the boiler with air instead of steam inside the boiler 12, the pressure tends to be higher. Thus, a lower preset value may be used to ensure the pressure during start-up being under control. After activating the steam trigger 48, the air will be released together with the steam. Afterwards, higher set temperature values may be used.

A further reduced embodiment of the invention comprises a simple boiler system, for example a boiler 12 without the water tank 40, the electrical pump 38, the de-airing valve 42, and the feed water inlet 36. As a temperature sensor 24 a thermostatic switch can be used. The power control of the heating device 22 can be performed by the thermostatic switch directly without the need for an additional electronic control unit 26. Thus, the pressure is controlled at one level, if the thermostatic switch only works at one temperature level.

Figure 2:
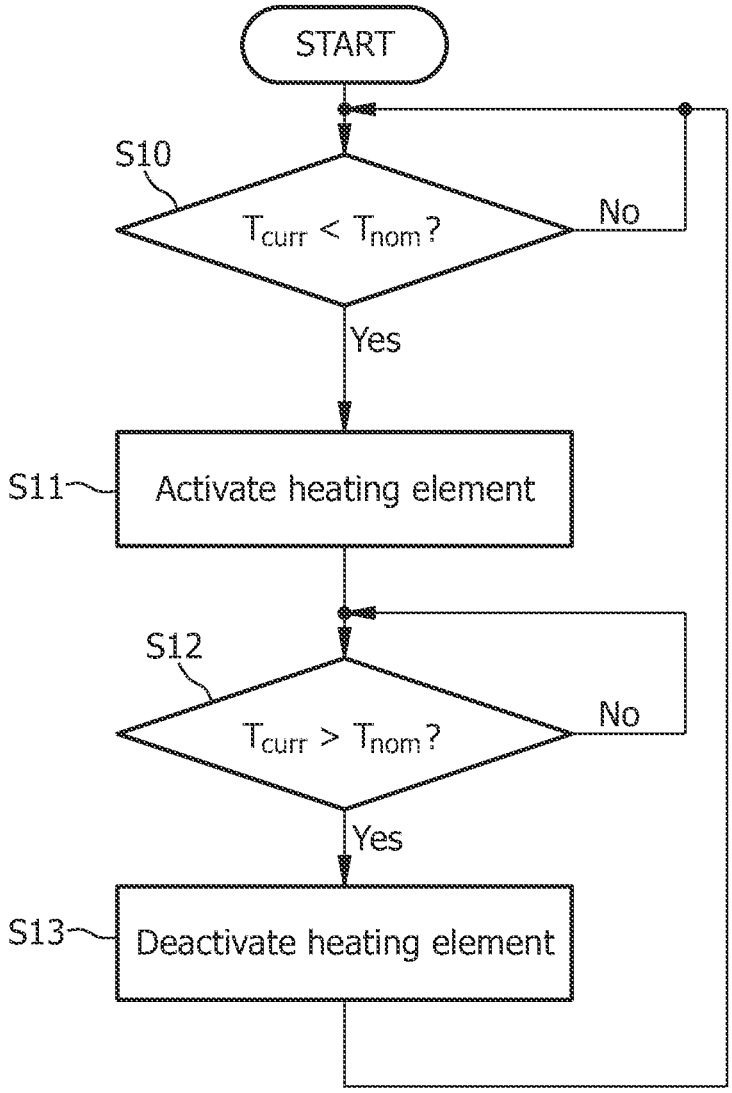
FIG. 2 shows a flow diagram of a temperature cycle.

FIG. 2 shows a flow diagram of a temperature cycle. In step S10, the current temperature $T_{curr}$ of water to be heated is compared with the nominal set temperature $T_{nom}$. If the current temperature $T_{curr}$ is lower than the nominal temperature $T_{nom}$, the heating element for heating the water is activated (S11). If the current temperature $T_{curr}$ is higher or equal to the nominal temperature $T_{nom}$, the process continues to monitor the current temperature in step S10. After turning on the heating element in step S11, in step S12 again the current water temperature $T_{curr}$ is compared with the nominal temperature $T_{nom}$. The temperature comparison in step S11 may be done with a different frequency than in step S10. If the current temperature $T_{curr}$ is higher than the nominal temperature $T_{nom}$, the heating element is deactivated in step S13. Otherwise, the monitoring of the current temperature $T_{curr}$ is continued in step S12. After turning off the heating element in step S13, the process continues in step S10 and the temperature cycle is finished. This is a simple way of controlling the temperature of water to be heated. The steps S10 to S13 may be defined as a temperature regulation cycle using the activating and deactivating of the heating element as a criterion.

Figure 3:
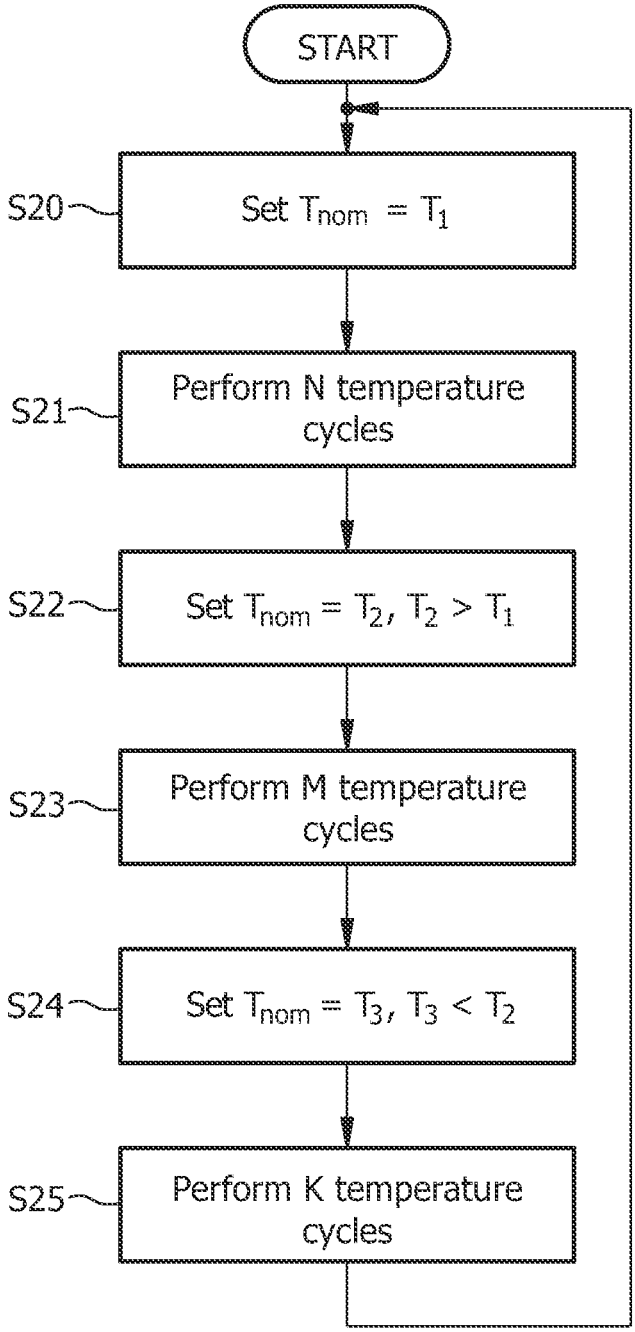
FIG. 3 shows a first embodiment of a method of controlling the pressure of steam according to the invention.

FIG. 3 shows a first embodiment of a method of controlling the pressure of steam according to the invention. In step S20, the nominal temperature $T_{nom}$ of water to be heated is set to a first temperature $T_1$. In step S21, a number of N temperature cycles as described in connection with FIG. 2 are performed. In step S22, the nominal temperature $T_{nom}$ is set to a second temperature $T_2$, the second temperature $T_2$ being higher than the first temperature $T_1$. In step S23, M temperature cycles are performed at the higher nominal temperature $T_2$. Afterwards, in step S24, the nominal temperature $T_{nom}$ is lowered to a third temperature $T_3$, the third temperature $T_3$ being lower than the second temperature $T_2$. After performing K temperature cycles, the process continues with step S20 or, alternatively, with step S22. Thus, a higher temperature level $T_2$ is provided during M temperature cycles allowing the generation of a higher pressure range.

Figure 4:
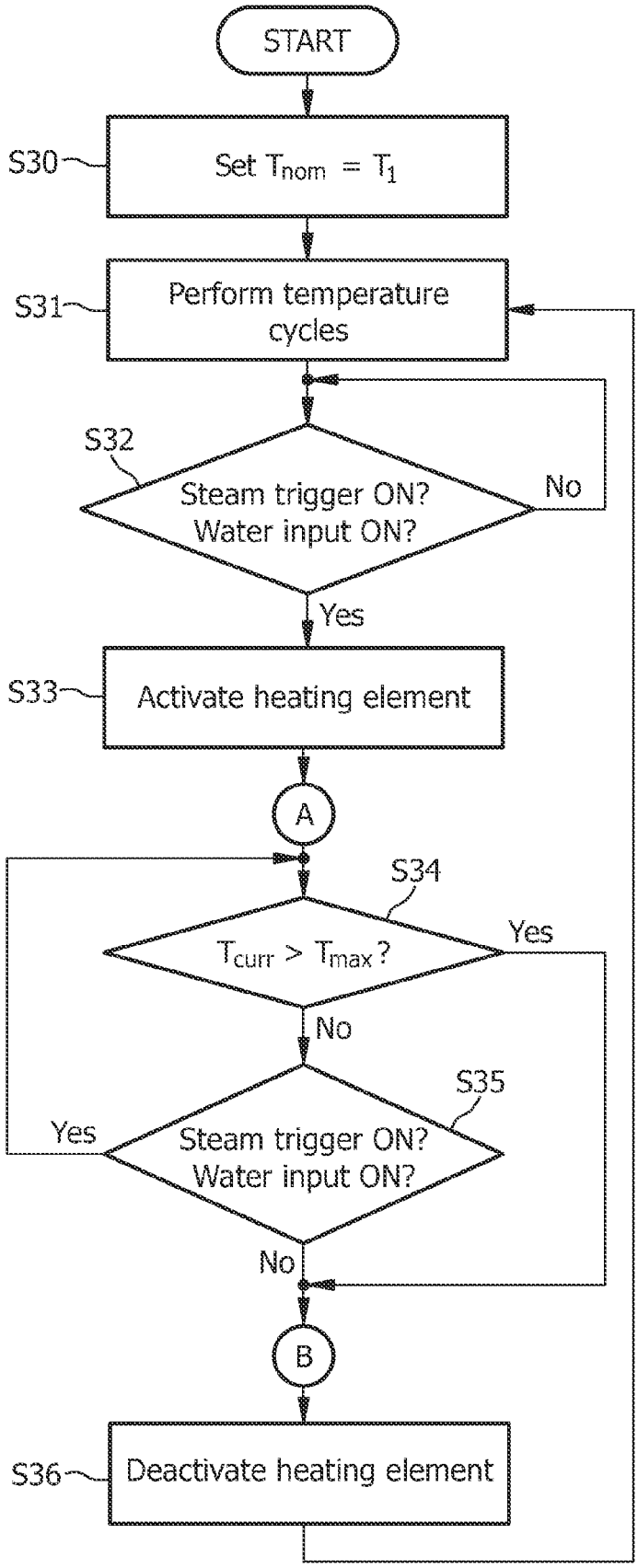
FIG. 4 shows a second embodiment of a method of controlling the pressure of steam according to the invention.

FIG. 4 shows a second embodiment of a method of controlling the pressure of steam according to the invention. In step S30, the nominal temperature $T_{nom}$ of water to be heated is set to a first temperature $T_1$. Afterwards, in step S31, a—preferably not predetermined—number of temperature cycles as defined above is performed. During these temperature cycles, the activation of a steam trigger, i.e. the initiation of a steam output, and the activation of the water pump are monitored (S32). If one of the mentioned events takes place, the process continues in step S33. Otherwise, the monitoring continues in step S32. In step S33, the heating element is turned on and the water is heated. During this heating, several events are monitored. If one of the events takes place, the heating element is turned off. First, in step S34, the current temperature of the water, $T_{curr}$, is compared with a maximum temperature $T_{max}$. If the current temperature $T_{curr}$ exceeds the maximum temperature $T_{max}$, the heating element is turned off and the process continues in step S36. Second, the steam trigger and/or the water pump are monitored. If one of the two signals shows, that the steam trigger is turned off or the water pump is not operating anymore, the process continues in step S36. Otherwise, the monitoring of the events is continued in step S34. In step S36, the heating element is turned off and the process continues in step S31. With this method, the loss of heat due to a steam output and/or a water input is compensated by turning on the heating element instantaneously. The heating element delivers heat into the water, until the heat loss is stopped or a maximum temperature is reached. Thus, the feedback time of the controlling device can be reduced.

Figure 5:
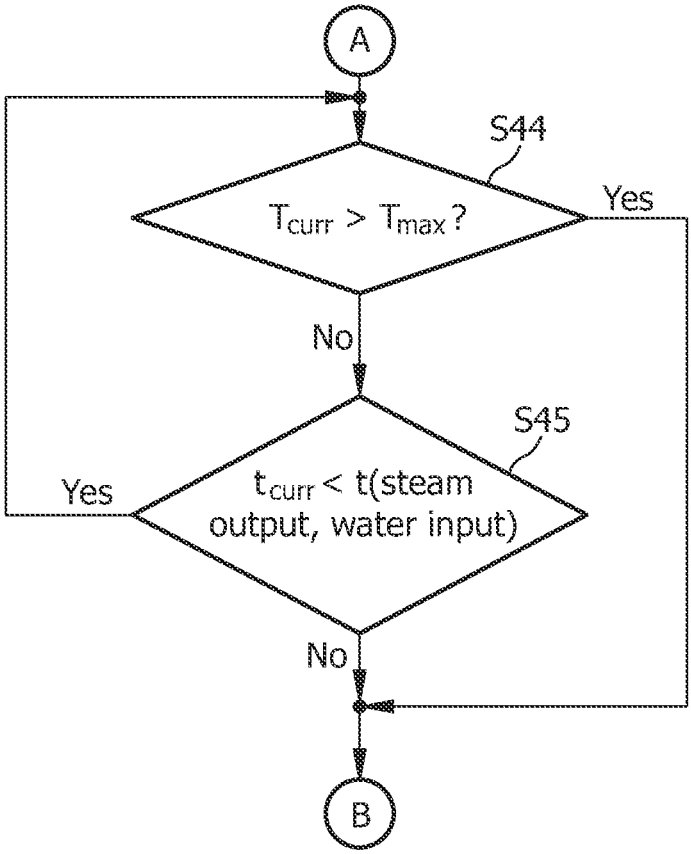
FIG. 5 shows an alternative second embodiment of a method of controlling the pressure of steam according to the invention.

FIG. 5 shows an alternative second embodiment of a method of controlling the pressure of steam according to the invention. In this alternative method the steps S34 and S35 of FIG. 4 are replaced by the steps S44 and S45. In step S44, the current temperature $T_{curr}$, of water to be heated is compared with a maximum temperature $T_{max}$. If the current temperature $T_{curr}$ exceeds the maximum temperature $T_{max}$, the process continues in step S36. In step S45, the time t leaving the heating element activated is determined as a function of the steam output and/or the water input. Accordingly, during this time t the heating element delivers heat into the water. After this time, the method continues with step S36. Also during step S45 the current water temperature is monitored continuously, in view of the maximum temperature $T_{max}$. By this method, the compensation of the heat loss may be adjusted according to the heat power being transferred into the water.

Equivalents and modifications not described above may also be employed without departing from the scope of the invention, which is defined in the accompanying claims.

The invention claimed is:

1. A steam generating apparatus, comprising:

a body for receiving water to be heated and comprising a first portion comprising a first metal;

a heating device comprising a second portion comprising a second metal, wherein the heating device comprises a heating plate connected with the body by forming an intermetallic layer between the first portion and the second portion, the intermetallic layer comprising a third metal;

a temperature sensor for measuring a temperature that is indicative of a pressure inside the body is arranged in thermal contact to the heating device outside the body; and a controller configured to set three different target water temperatures for three different time periods, wherein a second target water temperature of the three different target water temperatures, set for a second time period after a first time period, is higher than a first target water temperature set for the first time period, and higher than a third target water temperature of the three different target water temperatures, set for a third time period after the second time period.

2. The steam generating apparatus according to claim 1, the first metal being stainless steel.

3. The steam generating apparatus according to claim 1, the second metal being aluminum or an aluminum alloy.

4. The steam generating apparatus according to claim 1, the intermetallic layer being formed by soldering and/or brazing and/or welding.

5. The steam generating apparatus according to claim 1, the heating plate comprising a heating element.

6. The steam generating apparatus according to claim 1, the heating device comprising control means for controlling the temperature of the water.

7. The steam generating apparatus of claim 1, wherein at least one of the first metal and the second metal comprises a mixture containing two or more metallic elements.

8. The steam generating apparatus of claim 1, wherein at least one of the first metal and the second metal comprises a mixture containing two or more metallic and non-metallic elements.

9. A method of controlling the pressure of steam in a steam generating apparatus comprising:

a body for receiving water to be heated and comprising a first portion comprising a first metal;

a heating device comprising a second portion comprising a second metal, the body being connected with a heating plate of the heating device by forming an intermetallic layer between the first portion and the second portion, and a temperature sensor for measuring a temperature that is indicative of a pressure inside the body, the temperature sensor being arranged in thermal contact to the heating device outside the body, the method comprising the steps:

setting the target water temperature for a first time period to a first set temperature;

setting the target water temperature for a second time period to a second set temperature higher than the first set temperature;

setting the target water temperature for a third time period to a third set temperature lower than the second set temperature.

10. The method of controlling the pressure of steam in a steam generating apparatus according to claim 9, the beginning of the second time period and/or the duration of the second time period and/or the second set temperature being at least one of the following:

predetermined;

a function of the steam output of the steam generating device;

a function of the water input of the steam generating device.

11. The method of controlling the pressure of steam in a steam generating apparatus according to claim 9, wherein the duration of the second time period equals the duration of the steam output or the duration of the water input.

12. The method of controlling the pressure of steam in a steam generating apparatus according to claim 9, wherein the second time period is elongated by a time period being a function of at least one of the following:

the duration of the steam output;

the duration of the water input.

13. The method of controlling the pressure of steam in a steam generating apparatus according to claim 9, wherein the step of controlling the water temperature at the second temperature comprises the step of activating the heating device, in the case of at least one of the following:

the current water temperature is lower than the second temperature;

a steam output is requested;

a water input is performed.

14. The method of controlling the pressure of steam in a steam generating apparatus according to claim 9, wherein the step of controlling the water temperature at the second temperature comprises the step of deactivating the heating device, if the current water temperature is higher than a maximum temperature.

15. The method of controlling the pressure of steam in a steam generating apparatus according to claim 9, wherein the step of controlling the water temperature at the second temperature comprises the step of deactivating the heating device after a time period being a function of at least one of the following:

the duration of the steam output;

the duration of the water input.

16. A steam generating apparatus comprising:

a body for receiving water to be heated and comprising a first portion comprising a first metal;

a heating device comprising a second portion comprising a second metal, the body being connected with a heating plate of the heating device by forming an intermetallic layer between the first portion and the second portion, and a temperature sensor for measuring a temperature that is indicative of a pressure inside the body, the temperature sensor being arranged in thermal contact to the heating device outside the body, and a controller configured to:

set a target water temperature for a first time period to a first set temperature;

set the target water temperature for a second time period to a second set temperature higher than the first set temperature; and set the target water temperature for a third time period to a third set temperature lower than the second set temperature.

17. The steam generating apparatus of claim 16, wherein the intermetallic layer comprises a third metal.

18. The steam generating apparatus according to claim 16, wherein the first metal us stainless steel.

19. The steam generating apparatus according to claim 16, the second metal being aluminum or an aluminum alloy.

20. The steam generating apparatus according to claim 16, the intermetallic layer being formed by soldering and/or brazing and/or welding.

21. The steam generating apparatus according to claim 16, the heating plate comprising a heating element.

22. The steam generating apparatus according to claim 16, the heating device comprising control means for controlling the temperature of the water.

* * * * *